US007620188B2

(12) United States Patent
Inoue et al.

(10) Patent No.: US 7,620,188 B2
(45) Date of Patent: Nov. 17, 2009

(54) CYLINDER RESPONSIVE VIBRATORY NOISE CONTROL APPARATUS

(75) Inventors: Toshio Inoue, Tochigi-ken (JP); Satoru Minowa, Mooka (JP); Akira Takahashi, Tochigi-ken (JP); Yoshio Nakamura, Neyagawa (JP); Masahide Onishi, Osaka (JP)

(73) Assignees: Honda Motor Co., Ltd., Tokyo (JP); Panasonic Corporation, Osaka (JP)

( * ) Notice: Subject to any disclaimer, the term of this patent is extended or adjusted under 35 U.S.C. 154(b) by 961 days.

(21) Appl. No.: 10/866,986

(22) Filed: Jun. 15, 2004

(65) Prior Publication Data

US 2004/0258251 A1 Dec. 23, 2004

(30) Foreign Application Priority Data

Jun. 17, 2003 (JP) ..... 2003-171696

(51) Int. Cl.
*G10K 11/16* (2006.01)

(52) U.S. Cl. ..... 381/71.4; 381/86; 381/71.1; 381/71.8; 123/192.1; 123/481

(58) Field of Classification Search ..... 381/86, 381/94.1–94.5, 71.1–71.12; 123/192.1, 481
See application file for complete search history.

(56) References Cited

U.S. PATENT DOCUMENTS 5,359,662 A * 10/1994 Yuan et al. ..... 381/71.14
5,426,705 A 6/1995 Yokota et al.
5,485,523 A * 1/1996 Tamamura et al. ..... 381/71.4
5,493,616 A 2/1996 Iidata et al.
5,540,633 A * 7/1996 Yamanaka et al. ..... 477/107
5,581,619 A 12/1996 Shibata et al.
5,768,124 A 6/1998 Stothers et al.
5,809,152 A 9/1998 Nakamura et al.
5,939,625 A 8/1999 Torii et al.
6,588,392 B2 * 7/2003 Armstrong et al. ..... 123/192.1
6,891,954 B2 5/2005 Takahashi et al.
6,912,286 B1 6/2005 Daly
2003/0034002 A1 2/2003 Armstrong et al.
2004/0055814 A1 * 3/2004 Chae et al. ..... 181/207

FOREIGN PATENT DOCUMENTS

DE 42 36 155 A1 4/1994
EP 0 274 659 A1 7/1988

(Continued)

*Primary Examiner*—Vivian Chin
*Assistant Examiner*—Fatimat O Olaniran
(74) *Attorney, Agent, or Firm*—Arent Fox LLP

(57) ABSTRACT

An active vibratory noise control apparatus reduces vibratory noise which is produced in the passenger compartment of a vehicle based on vibratory noise generated by a variable-cylinder internal combustion engine that can selectively be operated in a full-cylinder operation mode in which all of the cylinders are operated and a partial-cylinder operation mode in which some of the cylinders are out of operation. The active vibratory noise control apparatus has a partial-cylinder operation mode determining circuit for determining whether the variable-cylinder internal combustion engine is in the partial-cylinder operation mode or not. Depending on a determined result from the partial-cylinder operation mode determining circuit, a transistor is turned on or off to switch an amplifying circuit which drives a speaker into and out of operation.

3 Claims, 6 Drawing Sheets

FOREIGN PATENT DOCUMENTS

| | | | |
|---|---|---|---|
| EP | 0 568 128 | A2 | 11/1993 |
| JP | 61-212638 | | 9/1986 |
| JP | 05-216484 | | 8/1993 |
| JP | 5-333880 | A | 12/1993 |
| JP | 06-130971 | | 5/1994 |
| JP | 06-282281 | A | 10/1994 |
| JP | 06-295187 | | 10/1994 |
| JP | 7-20884 | A | 1/1995 |
| JP | 7-140987 | A | 6/1995 |
| JP | 7-160278 | A | 6/1995 |
| JP | 7-182840 | A | 7/1995 |
| JP | 7-199966 | A | 8/1995 |
| JP | 7-199971 | A | 8/1995 |
| JP | 07-219560 | | 8/1995 |
| JP | 07-248780 | A | 9/1995 |
| JP | 7-287583 | A | 10/1995 |
| JP | 08-076772 | | 3/1996 |
| JP | 8-246910 | A | 9/1996 |
| JP | 08-319912 | A | 12/1996 |
| JP | 09-319381 | A | 12/1997 |
| JP | 2000-120767 | A | 4/2000 |
| JP | 2000-267674 | | 9/2000 |
| JP | 2001-005463 | A | 1/2001 |
| JP | 2001-282255 | A | 10/2001 |
| JP | 2001-282256 | A | 10/2001 |
| JP | 2001-282257 | A | 10/2001 |
| JP | 2001-329874 | A | 11/2001 |

* cited by examiner

CYLINDER RESPONSIVE VIBRATORY NOISE CONTROL APPARATUS

BACKGROUND OF THE INVENTION

1. Field of the Invention

The present invention relates to an active vibratory noise control apparatus for canceling vibratory noise which is produced in the passenger compartment of a vehicle by a variable-cylinder internal combustion engine that can selectively be operated in a full-cylinder operation mode in which all of the cylinders are operated and a partial-cylinder operation mode in which some of the cylinders are out of operation.

2. Description of the Related Art

Heretofore, there has been proposed a method of actively controlling vibratory noise caused in the passenger compartment of a vehicle by the internal combustion engine mounted on the vehicle, and there has also been put to practical use an active vibratory noise control apparatus. The active vibratory noise control apparatus which controls vibratory noise in the passenger compartment uses a signal representative of the rotational speed of the output shaft of the internal combustion engine, which is highly correlated to the vibratory noise to be controlled, or vibrations having a frequency based on suspension vibrations, as a basic signal. A canceling signal for canceling the vibratory noise in the passenger compartment is generated by an adaptive filter based on the basic signal. The canceling signal is converted from a digital signal into an analog signal, filtered by a low-pass filter, amplified by an amplifier, and applied to a speaker in the passenger compartment, which converts the canceling signal into a reproduced sound.

A reference signal generating circuit corrects the basic signal based on corrective data depending on the signal transfer characteristics in the passenger compartment between the speaker and a microphone located in the passenger compartment, generating a reference signal. The microphone detects an error signal based on the vibratory noise in the passenger compartment. An LMS algorithm processing circuit calculates filter coefficients of the adaptive filter based on the reference signal and the error signal in order to minimize the error signal, and sequentially updates the filter coefficients in an adaptive feed-forward control process for canceling the vibratory noise in the passenger compartment.

However, since the above active vibratory noise control apparatus performs the adaptive feed-forward control process based on the signal transfer characteristics between the speaker and the microphone, if the signal transfer characteristics are brought out of preset conditions as when a window of the vehicle is opened, then the signal transfer characteristics change, causing the active vibratory noise control apparatus to malfunction.

In an attempt to solve the above problem, there has been developed an active vibratory noise control apparatus which stops its vibratory noise control process by detecting when the signal transfer characteristics are brought out of preset conditions as when a window of the vehicle is opened (e.g., see Japanese laid-open patent publication No. 6-295187).

For reducing muffled sounds due to the vibratory noise caused by the internal combustion engine, the active vibratory noise control apparatus detects the frequency of the vibratory noise to be controlled from the rotational speed of the internal combustion engine, and generates a basic signal having a frequency based on the detected frequency.

There has been known a variable-cylinder internal combustion engine which changes the number of active cylinders depending on the operating state of the engine for improving fuel economy (e.g., see Japanese laid-open patent publication No. 61-212638).

If the above active vibratory noise control apparatus is incorporated in a vehicle powered by a variable-cylinder internal combustion engine, then since the engine produces different vibration frequencies (rotational order components to be controlled) due to fuel combustion upon rotation of the output shaft of the internal combustion engine in a full-cylinder operation mode and a partial-cylinder operation mode, the active vibratory noise control apparatus allows unexpected vibratory noise, such as annoying sounds, to be produced when the active vibratory noise control apparatus that is set to reduce vibratory noise in the passenger compartment in one of the above modes operates in the other mode because it tends to become unstable in the other mode.

The active vibratory noise control apparatus that stops the vibratory noise control process by detecting when the signal transfer characteristics are brought out of preset conditions is only designed to solve problems which arise when the signal transfer characteristics in the passenger compartment to be controlled change. The active vibratory noise control apparatus is unable to solve problems which are caused by switching between different vibration sources such as the full-cylinder operation mode and the partial-cylinder operation mode.

SUMMARY OF THE INVENTION

It is an object of the present invention to provide an active vibratory noise control apparatus which is capable of controlling vibratory noise produced by different vibration sources.

According to the present invention, there is provided an active vibratory noise control apparatus for reducing vibratory noise which is produced in the passenger compartment of a vehicle based on vibratory noise generated by a variable-cylinder internal combustion engine that can selectively be operated in a full-cylinder operation mode in which all of the cylinders are operated and a partial-cylinder operation mode in which some of the cylinders are out of operation, comprising partial-cylinder operation mode determining means for determining whether the variable-cylinder internal combustion engine is in the partial-cylinder operation mode or not, and switching control means for switching a process of reducing the vibratory noise in the passenger compartment into and out of operation depending on a determined result from the partial-cylinder operation mode determining means.

The above active vibratory noise control apparatus switches a vibratory noise control process for reducing vibratory noise into and out of operation depending on the determined result from the partial-cylinder operation mode determining means. Therefore, when the variable-cylinder internal combustion engine is switched into an operation mode which is not in conformity with preset conditions, even if the frequency (rotational order component) of the basic signal which is to be controlled, depending on the rotational speed of the output shaft of the internal combustion engine, is changed, the vibratory noise control process is inactivated, preventing the active vibratory noise control apparatus from becoming unstable.

According to the present invention, there is also provided an active vibratory noise control apparatus for reducing vibratory noise which is produced in the passenger compartment of a vehicle based on vibratory noise generated by a variable-cylinder internal combustion engine that can selectively be operated in a full-cylinder operation mode in which all of the cylinders are operated and a partial-cylinder operation mode in which some of the cylinders are out of operation, comprising number-of-active-cylinder determining means for determining the number of active cylinders of the variable-cylinder internal combustion engine, and basic frequency changing means for changing the frequency of a basic signal which is a frequency to be controlled, depending on the number of active cylinders determined by the number-of-active-cylinder determining means.

The above active vibratory noise control apparatus changes the frequency of the basic signal which is to be controlled depending on the number of active cylinders determined by the number-of-active-cylinder determining means. Therefore, when the internal combustion engine is switched between different operating states and the rotational order component to be controlled with respect to the rotational speed of the output shaft of the internal combustion engine is changed, the active vibratory noise control apparatus can perform a vibratory noise control process depending on the operating state for reducing the vibratory noise in the passenger compartment.

According to the present invention, there is further provided an active vibratory noise control apparatus for reducing vibratory noise which is produced in the passenger compartment of a vehicle based on vibratory noise generated by a variable-cylinder internal combustion engine that can selectively be operated in a full-cylinder operation mode in which all of the cylinders are operated and a partial-cylinder operation mode in which some of the cylinders are out of operation, comprising basic signal generating means for generating a basic signal having a frequency based on the frequency of the vibratory noise generated by the variable-cylinder internal combustion engine, an adaptive filter for generating a canceling signal based on the basic signal in order to cancel the vibratory noise which is produced in the passenger compartment based on the vibratory noise generated by the variable-cylinder internal combustion engine, a secondary vibration source for generating a canceling vibration or a canceling sound based on the canceling signal generated by the adaptive filter, error detecting means for detecting the difference between the vibratory noise in the passenger compartment and the canceling vibration or the canceling sound, and outputting a signal based on the difference as an error signal, reference signal generating means for correcting the basic signal based on a corrective value depending on signal transfer characteristics from the secondary vibration source to the error detecting means, thereby to generate a reference signal, filter coefficient updating means for sequentially updating filter coefficients of the adaptive filter for minimizing the error signal based on the reference signal and the error signal, number-of-active-cylinder determining means for determining the number of active cylinders of the variable-cylinder internal combustion engine, and basic frequency changing means for changing the frequency of the basic signal depending on the number of active cylinders determined by the number-of-active-cylinder determining means.

With the above active vibratory noise control apparatus, the frequency of the basic signal is changed depending on the number of active cylinders determined by the number-of-active-cylinder determining means. Consequently, when the internal combustion engine is switched between different operating states and the rotational order component to be controlled with respect to the rotational speed of the output shaft of the internal combustion engine is changed, the active vibratory noise control apparatus can perform a vibratory noise control process depending on the operating state for reducing the vibratory noise in the passenger compartment.

The above and other objects, features, and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Active vibratory noise control apparatus according to preferred embodiments of the present invention will be described below.

Figure 1:
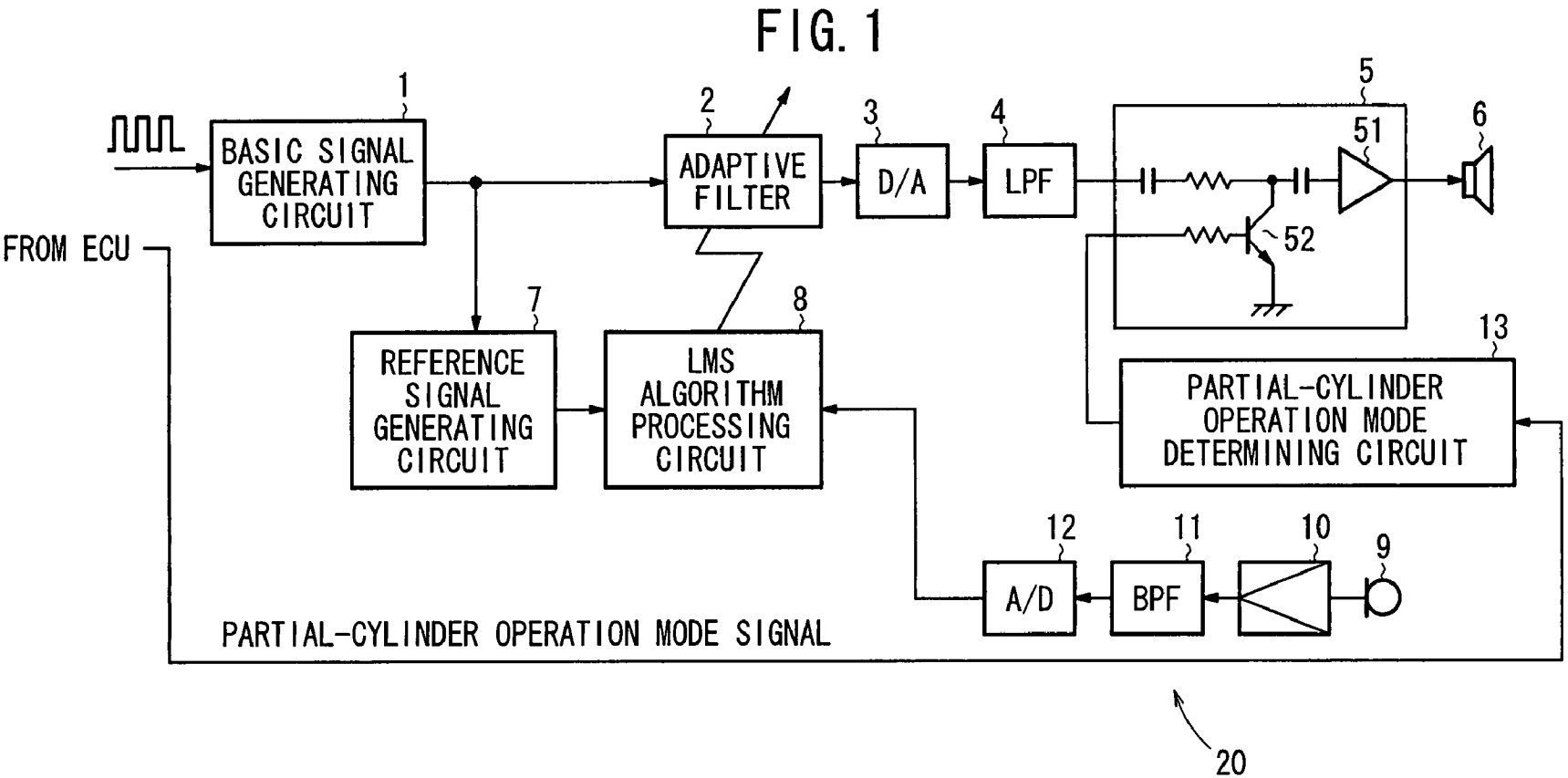
FIG. 1 is a block diagram of an active vibratory noise control apparatus according to an embodiment of the present invention.

FIG. 1 shows in block form an active vibratory noise control apparatus according to an embodiment of the present invention.

The active vibratory noise control apparatus, generally designated by 20 in FIG. 1, comprises a basic signal generating circuit 1, an adaptive filter 2, a D/A converter 3, a low-pass filter 4, an amplifying circuit 5, a speaker 6, a reference signal generating circuit 7, an LMS algorithm processing circuit 8, a microphone 9, an amplifying circuit 10, a bandpass filter 11, an A/D converter 12, and a partial-cylinder operation mode determining circuit 13.

The cancellation of vibratory noise produced by an engine as a vibratory noise source, e.g., vibratory noise produced in the passenger compartment of a vehicle by the rotation of a 4-cycle 4-cylinder internal combustion engine, will be described by way of example below. The 4-cycle 4-cylinder internal combustion engine produces vibrations due to torque variations thereof upon gas combustion that takes place four times each time the output shaft of the internal combustion engine makes two revolutions, causing vibratory noise in the passenger compartment of the vehicle. The 4-cycle 4-cylinder internal combustion engine produces a lot of vibratory noise that is referred to as a rotational secondary component having a frequency which is twice the rotational speed of the output shaft of the internal combustion engine.

The cancellation of vibratory noise produced in the passenger compartment of a vehicle by the rotation of a 4-cycle 6-cylinder internal combustion engine, will be described by way of example below. The 4-cycle 6-cylinder internal combustion engine produces vibrations due to torque variations thereof upon gas combustion that takes place six times each time the output shaft of the internal combustion engine makes two revolutions, causing vibratory noise in the passenger compartment of the vehicle. The 4-cycle 6-cylinder internal combustion engine produces a lot of vibratory noise that is referred to as a rotational tertiary component having a frequency which is three times the rotational speed of the output shaft of the internal combustion engine.

In the description given below, the cancellation of vibratory noise produced in the passenger compartment of a vehicle by the rotation of a 4-cycle 6-cylinder internal combustion engine, will be referred to. If the 4-cycle 6-cylinder internal combustion engine has a partial-cylinder operation mode in which three cylinders are out of operation, then the 4-cycle 6-cylinder internal combustion engine produces vibrations due to torque variations thereof upon gas combustion that takes place three times each time the output shaft of the internal combustion engine makes two revolutions, causing vibratory noise in the passenger compartment of the vehicle. The 4-cycle 6-cylinder internal combustion engine therefore produces a lot of vibratory noise that is referred to as a rotational 1.5th-order component.

Generally, the internal combustion engine produces more vibration or noise in the partial-cylinder operation mode than in the full-cylinder operation mode. Consequently, the partial-cylinder operation mode will be used as a preset condition in which the active vibratory noise control apparatus 20 operates.

The rotation of the output shaft of the internal combustion engine is detected by a sensor, and an output signal from the sensor is supplied to the basic signal generating circuit 1, which generates a basic signal that is a digital signal synchronous with vibratory noise produced by the vibratory noise source and having a frequency selected from the frequencies of vibratory noise generated by the vibratory noise source, i.e., a basic signal synchronous with the rotation of the output shaft and having a frequency depending on the frequency of the rotational 1.5th-order component.

The basic signal is supplied to the adaptive filter 2, which processes the basic signal and outputs a canceling signal for canceling the vibratory noise in the passenger compartment. The canceling signal is converted by the D/A converter 3 into an analog canceling signal, which is filtered by the low-pass filter 4. The canceling signal is then amplified by the amplifying circuit 5 and supplied to the speaker 6 which serves as a canceling sound generating means in the passenger compartment. The speaker 6 converts the canceling signal into a canceling sound to cancel the vibratory noise in the passenger compartment.

The amplifying circuit 5 comprises an amplifier 51 for amplifying the canceling signal output from the low-pass filter 4, and a transistor 52 as a switching control means for selectively grounding the input terminal of the amplifier 51 to cut off the input signal applied to the amplifier 51.

A partial-cylinder operation mode signal output from an internal combustion engine controller (ECU) is delivered to the partial-cylinder operation mode determining circuit 13. The partial-cylinder operation mode determining circuit 13 determines whether the internal combustion engine is in the full-cylinder operation mode or the partial-cylinder operation mode. The partial-cylinder operation mode determining circuit 13 applies a decision signal indicative of the determined operation mode to the base of the transistor 52. Specifically, when the partial-cylinder operation mode determining circuit 13 applies a signal indicative of the full-cylinder operation mode to turn on the transistor 52, the input terminal of the amplifier 51 is grounded thereby to shut off the amplifying circuit 5, de-energizing the active vibratory noise control apparatus 20. When the partial-cylinder operation mode determining circuit 13 applies a signal indicative of the partial-cylinder operation mode to turn off the transistor 52, the input terminal of the amplifier 51 is disconnected from ground thereby to make the amplifying circuit 5 active, energizing the active vibratory noise control apparatus 20.

The microphone 9 located in the passenger compartment detects the vibratory noise in the passenger compartment, and produces an error signal representative of the vibratory noise. The error signal output from the microphone 9 is amplified by the amplifying circuit 10, limited in band by the bandpass filter 11, and then converted into a digital error signal by the A/D converter 12.

The reference signal generating circuit 7 corrects the basic signal from the basic signal generating circuit 1 based on corrective data depending on signal transfer characteristics which include signal transfer characteristics of the speaker 6 and the microphone 9 and range between the speaker 6 and the microphone 9 in the passenger compartment, thereby generating a reference signal.

The LMS algorithm processing circuit 8, which corresponds to a filter coefficient updating means, performs LMS algorithm calculations based on the reference signal and the digital error signal to determine filter coefficients for minimizing the error signal, sequentially updates the filter coefficients of the adaptive filter 2 into the determined filter coefficients. The amplifying circuit 5 amplifies the canceling signal from the adaptive filter 2, and the speaker 6 converts the canceling signal into a canceling sound to cancel the vibratory noise in the passenger compartment.

Figure 2:
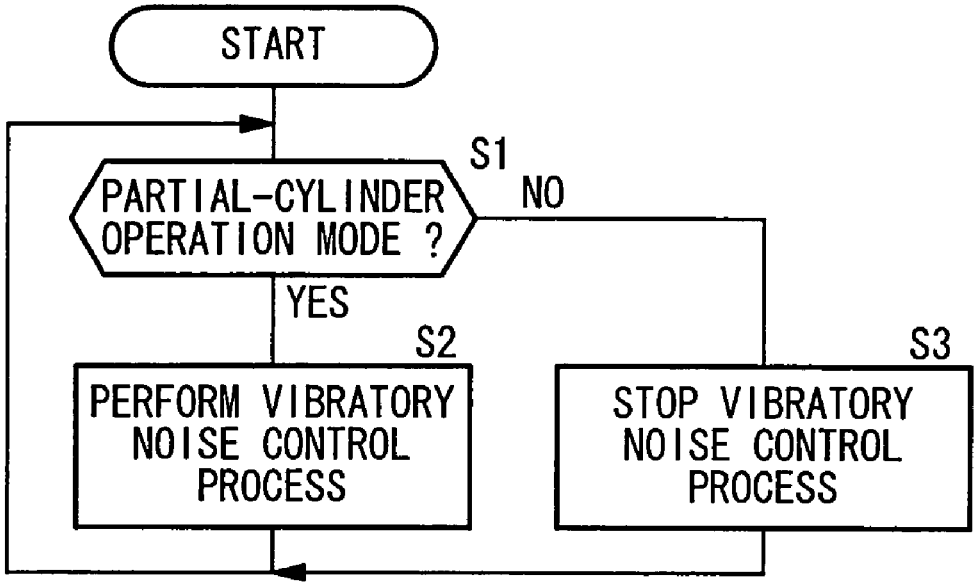
FIG. 2 is a flowchart of an operation sequence of the active vibratory noise control apparatus shown in FIG. 1.

Operation of the active vibratory noise control apparatus 20 will be described below with reference to FIG. 2.

When the active vibratory noise control apparatus 20 starts to operate, the partial-cylinder operation mode determining circuit 13 checks if the partial-cylinder operation mode signal output from the internal combustion engine controller represents the partial-cylinder operation mode or not in step S1. If the partial-cylinder operation mode determining circuit 13 judges that the partial-cylinder operation mode signal represents the partial-cylinder operation mode, then the partial-cylinder operation mode determining circuit 13 turns off the transistor 52. The amplifying circuit 5 amplifies the canceling signal to perform a vibratory noise control process in step S2. Then, control returns to step S1 to repeat the processing from step S1.

Step S2 is executed in the partial-cylinder operation mode wherein three of all the six cylinders of the internal combustion engine are out of operation. The basic signal generating circuit 1 generates a basic signal synchronous with the rotation of the output shaft of the internal combustion engine and having a frequency depending on the frequency of the rotational 1.5th-order component. The LMS algorithm processing circuit 8 determines filter coefficients for minimizing the error signal based on the reference signal and the error signal, and updates the filter coefficients of the adaptive filter 2 into the determined filter coefficients. The adaptive filter 2 then processes the basic signal according to the updated filter coefficients, and outputs a canceling signal controlled to minimize the error signal. The amplifying circuit 5 amplifies the canceling signal from the adaptive filter 2. The speaker 6 converts the canceling signal into a canceling sound to cancel the vibratory noise in the passenger compartment.

If the partial-cylinder operation mode determining circuit 13 judges that the internal combustion engine is in the full-cylinder operation mode in step S1, then the partial-cylinder operation mode determining circuit 13 turns on the transistor 52, stopping the vibratory noise control process in step S3. Thereafter, control returns to step S1 to repeat the processing from step S1.

Step S3 is executed in the full-cylinder operation mode wherein all the six cylinders of the internal combustion engine are in operation. The transistor 52 connects the input terminal of the amplifier 51 to ground, and the speaker 6 is not energized, producing no reproduced sound. Therefore, the active vibratory noise control apparatus 20 is essentially inoperative. The active vibratory noise control apparatus 20 is thus prevented from becoming unstable because the frequency of the basic signal which serves as a basis for the canceling signal is different from the frequency of the noise, and hence from producing unexpected vibratory noise, such as annoying sounds.

In FIG. 1, the vibratory noise control process is switched into and out of operation by the transistor 52 which is a piece of hardware. However, the vibratory noise control process may be switched into and out of operation by a software program as shown in FIG. 2.

The active vibratory noise control apparatus 20 may be operated in a manner that is the reversal of the above process. Specifically, the sensor detects the rotation of the output shaft of the internal combustion engine, and supplies an output signal to the basic signal generating circuit 1, which generates a basic signal synchronous with the rotation of the output shaft and having a frequency depending on the frequency of the rotational tertiary component. When the partial-cylinder operation mode determining circuit 13 judges that the internal combustion engine is in the full-cylinder operation mode, it turns off the transistor 52 to energize the amplifying circuit 5, thus operating the active vibratory noise control apparatus 20. When the partial-cylinder operation mode determining circuit 13 judges that the internal combustion engine is in the partial-cylinder operation mode, it turns on the transistor 52 to de-energize the amplifying circuit 5, thus inactivating the active vibratory noise control apparatus 20.

According to the above operation, when the 4-cycle 6-cylinder internal combustion engine is in the full-cylinder operation mode as determined by the partial-cylinder operation mode determining circuit 13, the basic signal generating circuit 1 generates a basic signal synchronous with the rotation of the output shaft and having a frequency depending on the frequency of the rotational tertiary component. The LMS algorithm processing circuit 8 updates the filter coefficients of the adaptive filter 2 into the filter coefficients based on the reference signal and the error signal. The adaptive filter 2 then processes the basic signal according to the updated filter coefficients, and outputs a canceling signal controlled to minimize the error signal. The amplifying circuit 5 amplifies the canceling signal from the adaptive filter 2. The speaker 6 converts the canceling signal into a canceling sound to cancel the vibratory noise in the passenger compartment.

When the partial-cylinder operation mode determining circuit 13 judges that the 4-cycle 6-cylinder internal combustion engine is in the partial-cylinder operation mode, the partial-cylinder operation mode determining circuit 13 turns on the transistor 52, connecting the input terminal of the amplifier 51 to ground, and the speaker 6 is not energized, producing no reproduced sound. Therefore, the active vibratory noise control apparatus 20 is essentially inoperative. The active vibratory noise control apparatus 20 is thus prevented from becoming unstable, and hence from producing unexpected vibratory noise, such as annoying sounds.

An active vibratory noise control apparatus according to another embodiment of the present invention will be described below.

Figure 3:
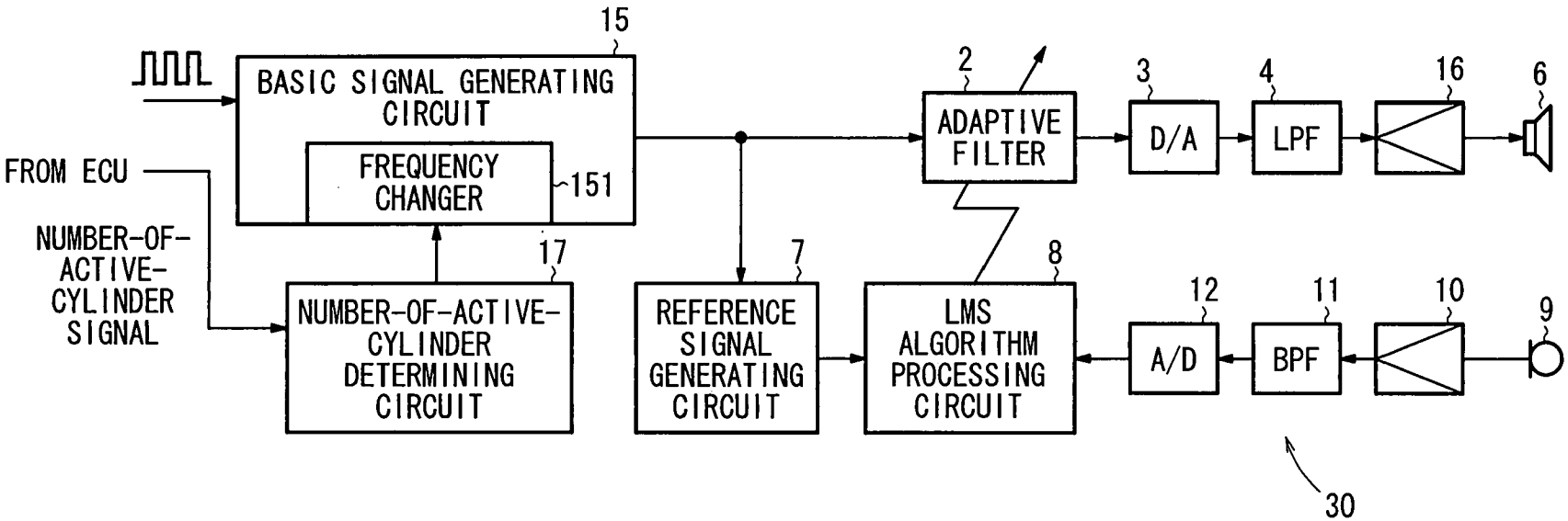
FIG. 3 is a block diagram of an active vibratory noise control apparatus according to another embodiment of the present invention.

FIG. 3 shows in block form an active vibratory noise control apparatus according to another embodiment of the present invention.

The active vibratory noise control apparatus, generally designated by 30 in FIG. 3, comprises a basic signal generating circuit 15, an adaptive filter 2, a D/A converter 3, a low-pass filter 4, an amplifying circuit 16, a speaker 6, a reference signal generating circuit 7, an LMS algorithm processing circuit 8, a microphone 9, an amplifying circuit 10, a bandpass filter 11, an A/D converter 12, and a number-of-active-cylinder determining circuit 17.

It is assumed that the active vibratory noise control apparatus 30 is associated with a 4-cycle 6-cylinder internal combustion engine, and is designed for canceling vibratory noise produced in the passenger compartment of a vehicle by the rotation of the output shaft of the 4-cycle 6-cylinder internal combustion engine. When the internal combustion engine is in the partial-cylinder operation mode, three of all the six cylinders of the internal combustion engine are out of operation.

When the internal combustion engine is in the full-cylinder operation mode, the internal combustion engine produces vibrations due to torque variations thereof upon gas combustion that takes place six times each time the output shaft of the internal combustion engine makes two revolutions, causing vibratory noise in the passenger compartment of the vehicle. The internal combustion engine produces a lot of vibratory noise that is referred to as a rotational tertiary component. When the internal combustion engine is in the partial-cylinder operation mode, the internal combustion engine produces vibrations due to torque variations thereof upon gas combustion that takes place three times each time the output shaft of the internal combustion engine makes two revolutions, causing vibratory noise in the passenger compartment of the vehicle. The internal combustion engine produces a lot of vibratory noise that is referred to as a rotational 1.5th-order component.

A number-of-active-cylinder signal output from an internal combustion engine controller (ECU) is delivered to the number-of-active-cylinder determining circuit 17, which determines the number of active cylinders, i.e., determines whether three cylinders are active (the internal combustion engine is in the partial-cylinder operation mode) or six cylinders are active (the internal combustion engine is in the full-cylinder operation mode). The number-of-active-cylinder determining circuit 17 supplies a decision signal indicative of the determined number of active cylinders to the base signal generating circuit 15.

The base signal generating circuit 15 includes a frequency changer 151. The rotation of the output shaft of the internal combustion engine is detected by a sensor, and an output signal from the sensor is supplied to the basic signal generating circuit 15, which generates a basic signal that is a digital signal synchronous with vibratory noise produced by the vibratory noise source and having a frequency selected from the frequencies of vibratory noise generated by the vibratory noise source. The number-of-active-cylinder determining circuit 17 supplies a decision signal indicative of the determined number of active cylinders, i.e., three active cylinders or six active cylinders, to the frequency changer 151. When the number-of-active-cylinder determining circuit 17 supplies a decision signal indicative of six active cylinders to the frequency changer 151, the basic signal generating circuit 15 generates, in coaction with the frequency changer 151, a basic signal synchronous with the rotation of the output shaft of the internal combustion engine and having a frequency depending on the frequency of a rotational tertiary component. When the number-of-active-cylinder determining circuit 17 supplies a decision signal indicative of three active cylinders to the frequency changer 151, the basic signal generating circuit 15 generates a basic signal synchronous with the rotation of the output shaft of the internal combustion engine and having a frequency depending on the frequency of a rotational 1.5th-order component.

The generated basic signal is supplied to the adaptive filter 2, which processes the basic signal and outputs a canceling signal for canceling the vibratory noise in the passenger compartment. The canceling signal is converted by the D/A converter 3 into an analog canceling signal, which is filtered by the low-pass filter 4. The canceling signal is then amplified by the amplifying circuit 16 and supplied to the speaker 6. The speaker 6 converts the canceling signal into a canceling sound to cancel the vibratory noise in the passenger compartment.

The microphone 9 located in the passenger compartment detects the vibratory noise in the passenger compartment, and produces an error signal representative of the vibratory noise. The error signal output from the microphone 9 is amplified by the amplifying circuit 10, limited in band by the bandpass filter 11, and then converted into a digital error signal by the A/D converter 12.

The reference signal generating circuit 7 corrects the basic signal from the basic signal generating circuit 1 based on corrective data depending on signal transfer characteristics which include signal transfer characteristics of the speaker 6 and the microphone 9 and range between the speaker 6 and the microphone 9 in the passenger compartment, thereby generating a reference signal.

The LMS algorithm processing circuit 8 performs LMS algorithm calculations based on the reference signal and the digital error signal to determine filter coefficients for minimizing the error signal, sequentially updates the filter coefficients of the adaptive filter 2 into the determined filter coefficients for minimizing the error signal. The amplifying circuit 5 amplifies the canceling signal from the adaptive filter 2, and the speaker 6 converts the canceling signal into a canceling sound to cancel the vibratory noise in the passenger compartment.

Figure 4:
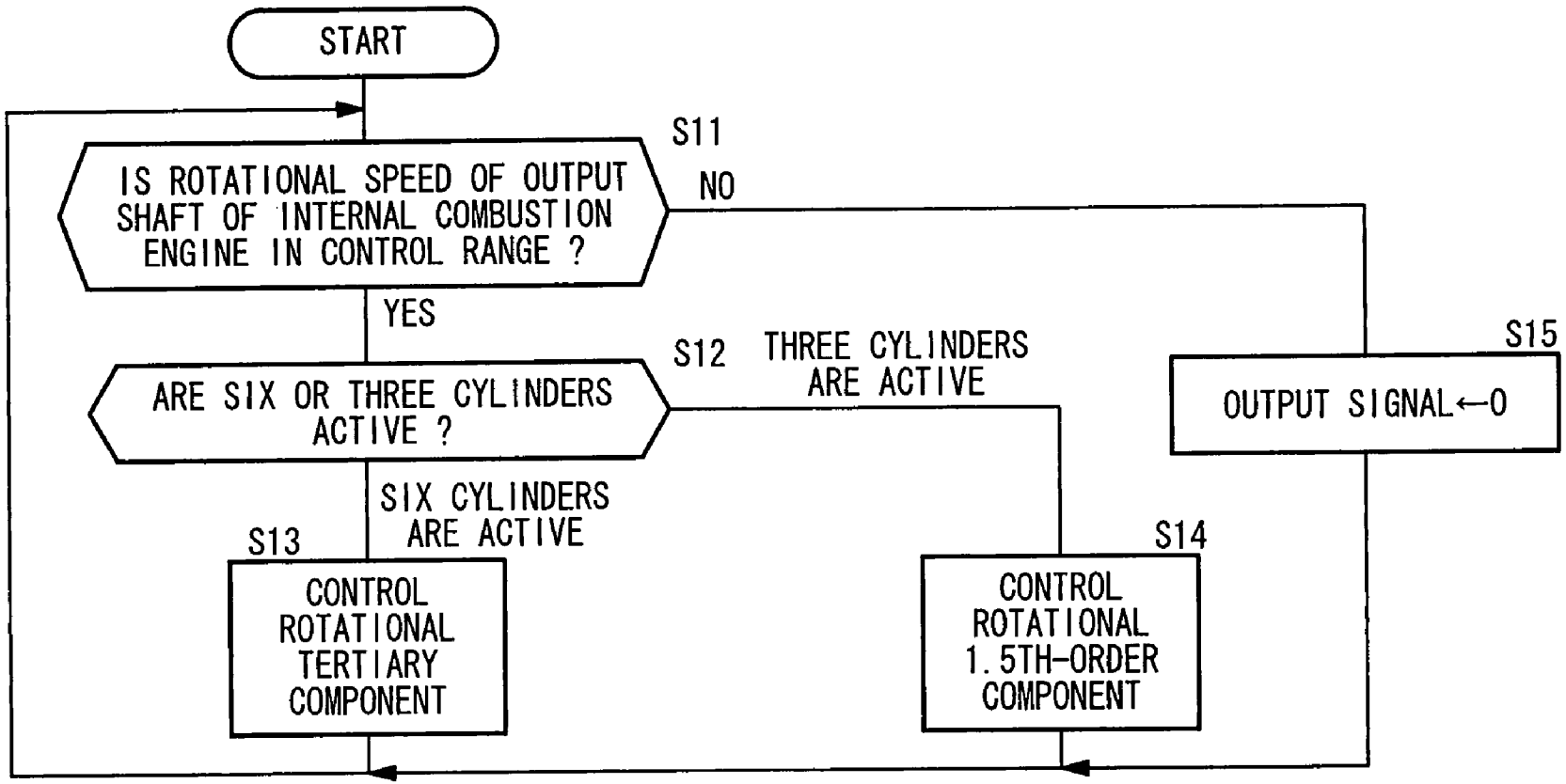
FIG. 4 is a flowchart of an operation sequence of the active vibratory noise control apparatus shown in FIG. 3.

Operation of the active vibratory noise control apparatus 30 will be described below with reference to FIG. 4.

When the active vibratory noise control apparatus 30 starts to operate, it checks if the rotational speed of the output shaft of the internal combustion engine is in a control range or not in step S11. If it is judged in step S11 that the rotational speed of the output shaft of the internal combustion engine is in the control range, then the number-of-active-cylinder determining circuit 17 checks if six cylinders or three cylinders are active in step S12.

If it is judged in step S12 that six cylinders are active, then the basic signal generating circuit 15 generates, in coaction with the frequency changer 151, a basic signal synchronous with the rotation of the output shaft of the internal combustion engine and having a frequency depending on the frequency of a rotational tertiary component. The LMS algorithm processing circuit 8 updates the filter coefficients of the adaptive filter 2 into the filter coefficients based on the reference signal and the digital error signal. The adaptive filter 2 with the updated filter coefficients processes the basic signal and outputs a canceling signal controlled to minimize the error signal. The canceling signal from the adaptive filter 2 is amplified by the amplifying circuit 16 and then converted by the speaker 6 into a canceling sound to cancel the vibratory noise in the passenger compartment in step S13. Then, control returns to step S11 to repeat the processing from step S11.

If it is judged in step S12 that three cylinders are active, then the basic signal generating circuit 15 generates, in coaction with the frequency changer 151, a basic signal synchronous with the rotation of the output shaft of the internal combustion engine and having a frequency depending on the frequency of a rotational 1.5th-order component. The LMS algorithm processing circuit 8 updates the filter coefficients of the adaptive filter 2 into the filter coefficients based on the reference signal and the digital error signal. The adaptive filter 2 with the updated filter coefficients processes the basic signal and outputs a canceling signal controlled to minimize the error signal. The canceling signal from the adaptive filter 2 is amplified by the amplifying circuit 16 and then converted by the speaker 6 into a canceling sound to cancel the vibratory noise in the passenger compartment in step S14. Then, control returns to step S11 to repeat the processing from step S11.

If it is judged in step S11 that the rotational speed of the output shaft of the internal combustion engine is not in the control range, then the output signal of the active vibratory noise control apparatus 30 is set to 0 in step S15. Thereafter, control returns to step S11 to repeat the processing from step S11.

With the active vibratory noise control apparatus 30, the number of active cylinders of the internal combustion engine is determined by the number-of-active-cylinder determining circuit 17, and the frequency of the basic signal is changed depending on the determined number of active cylinders. Therefore, even when the operation modes are changed depending on the number of active cylinders, and the rotational order component to be controlled is changed, the vibratory noise control process depending on the operating state of the internal combustion engine is performed for canceling the vibratory noise in the passenger compartment.

Figure 5:
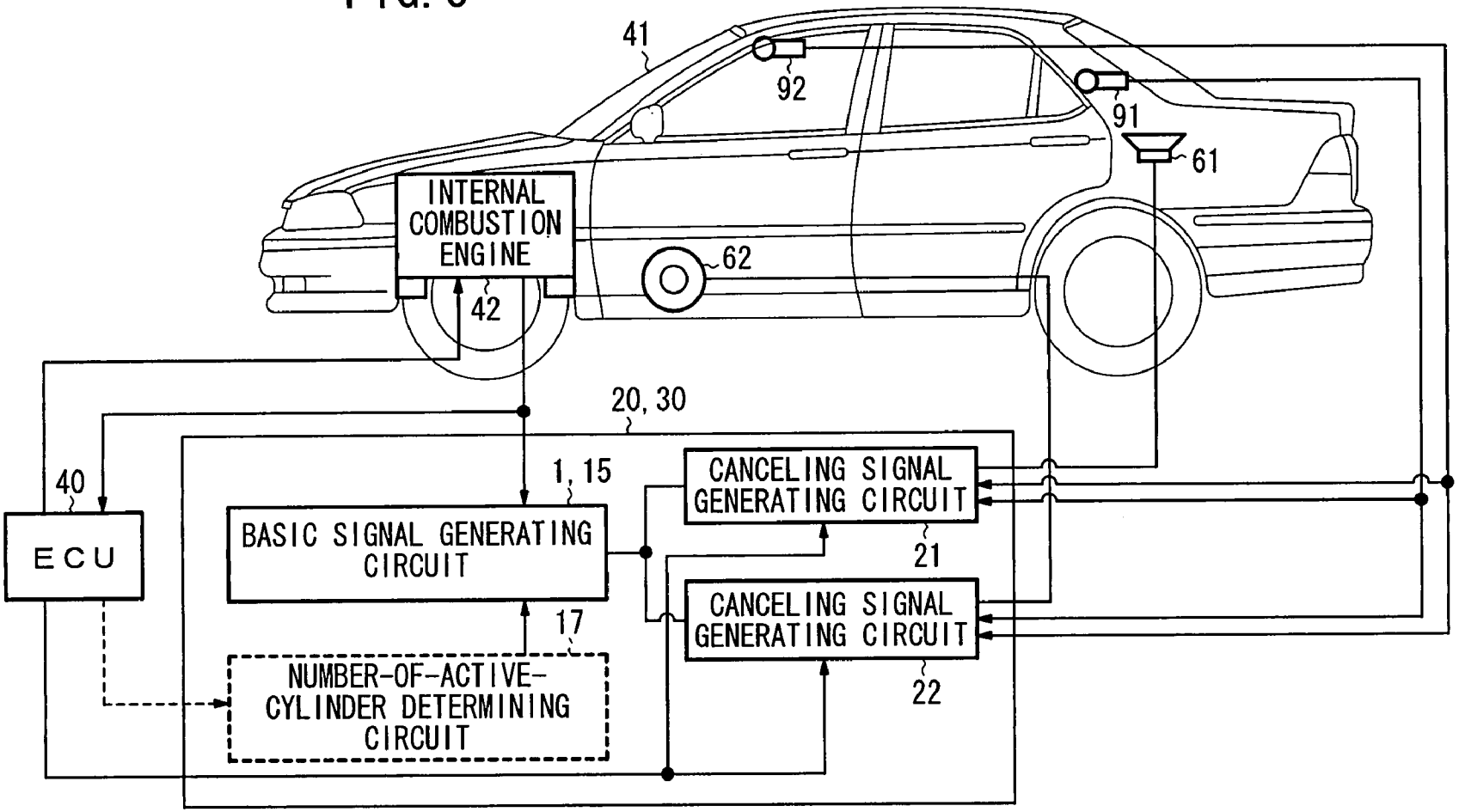
FIG. 5 is a block diagram showing the active vibratory noise control apparatus according to the present invention as incorporated in a vehicle.

An example in which the active vibratory noise control apparatus according to the present invention is incorporated in a vehicle is schematically shown in FIG. 5.

FIG. 5 schematically shows an arrangement for canceling muffled sounds in the passenger compartment of a vehicle 41 with the active vibratory noise control apparatus 20 which has two microphones.

In FIG. 5, the active vibratory noise control apparatus 20 is simplified by a basic signal generating circuit 1 and canceling signal generating circuits 21, 22 for being supplied with a basic signal output from the basic signal generating circuit 1 and generating a canceling signal.

As shown in FIG. 1, each of the canceling signal generating circuits 21, 22 comprises the adaptive filter 2, the D/A converter 3, the low-pass filter 4, the amplifying circuit 5, the reference signal generating circuit 7, the LMS algorithm processing circuit 8, the amplifying circuit 10, the bandpass filter 11, the A/D converter 12, and the partial-cylinder operation mode determining circuit 13.

A speaker 61 is disposed in a given position behind the rear seats in the vehicle 41, and is driven by a canceling signal output from the canceling signal generating circuit 21. Another speaker 62 is disposed in a given position on a lower portion of a front seat in the vehicle 41 and is driven by a canceling signal output from the canceling signal generating circuit 22.

A microphone 91 is disposed on a ceiling portion of the passenger compartment which faces the back of the rear seat of the vehicle 41, and delivers a detected error signal to the canceling signal generating circuit 21. Another microphone 92 is disposed on a central portion facing the front seat of the vehicle 41, and delivers a detected error signal to the canceling signal generating circuit 22.

A signal indicative of the detected rotation of the output shaft of an internal combustion engine 42 mounted on the vehicle 41 is supplied to the basic signal generating circuit 1. A partial-cylinder operation mode signal output from an internal combustion engine controller (ECU) 40 is delivered to the transistor, as a switching control means, in the amplifying circuit 5 (see FIG. 1) of each of the canceling signal generating circuits 21, 22 for controlling operation of the amplifying circuit 5.

With the above arrangement, canceling signals controlled to minimize error signals from the microphones 91, 92 by the basic signal generating circuit 1 and the canceling signal generating circuits 21, 22, which coact with the speakers 61, 62 and the microphones 91, 92, are applied to the speakers 61, 62 to cancel the vibratory noise in the passenger compartment of the vehicle 41. The process of canceling the vibratory noise is the same as the process described above with respect to the active vibratory noise control apparatus 20.

The canceling signal generating circuit 21 generates a canceling signal using reference signals generated depending on the signal transfer characteristics between the speaker 61 and the microphone 91 and the signal transfer characteristics between the speaker 61 and the microphone 92; and the canceling signal generating circuit 22 generates a canceling signal using reference signals generated depending on the signal transfer characteristics between the speaker 62 and the microphone 92 and the signal transfer characteristics between the speaker 62 and the microphone 91. The generated canceling signals are applied to the speakers 61, 62, which convert them into canceling sounds to cancel the vibratory noise in the passenger compartment.

Operation of the active vibratory noise control apparatus 30 incorporated in a vehicle can easily be understood from the above description of operation of the active vibratory noise control apparatus 20. In the active vibratory noise control apparatus 30, the basic signal generating circuit 15 is used instead of the basic signal generating circuit 1, and the transistor 52 as a switching control means in the amplifying circuit 5 in each of the canceling signal generating circuits 21, 22 is not employed, but the number-of-active-cylinder determining circuit 17 is included. A number-of-active-cylinder signal output from the internal combustion engine controller 40 is supplied to the number-of-active-cylinder determining circuit 17, which generates a signal indicative of the determined number of active cylinders. The signal from the number-of-active-cylinder determining circuit 17 is applied to change the frequency of the basic signal generated by the basic signal generating circuit 15. The active vibratory noise control apparatus 30 generates canceling signals when three cylinders are active and also when six cylinders are active for canceling the vibratory noise in the passenger compartment.

Figure 6:
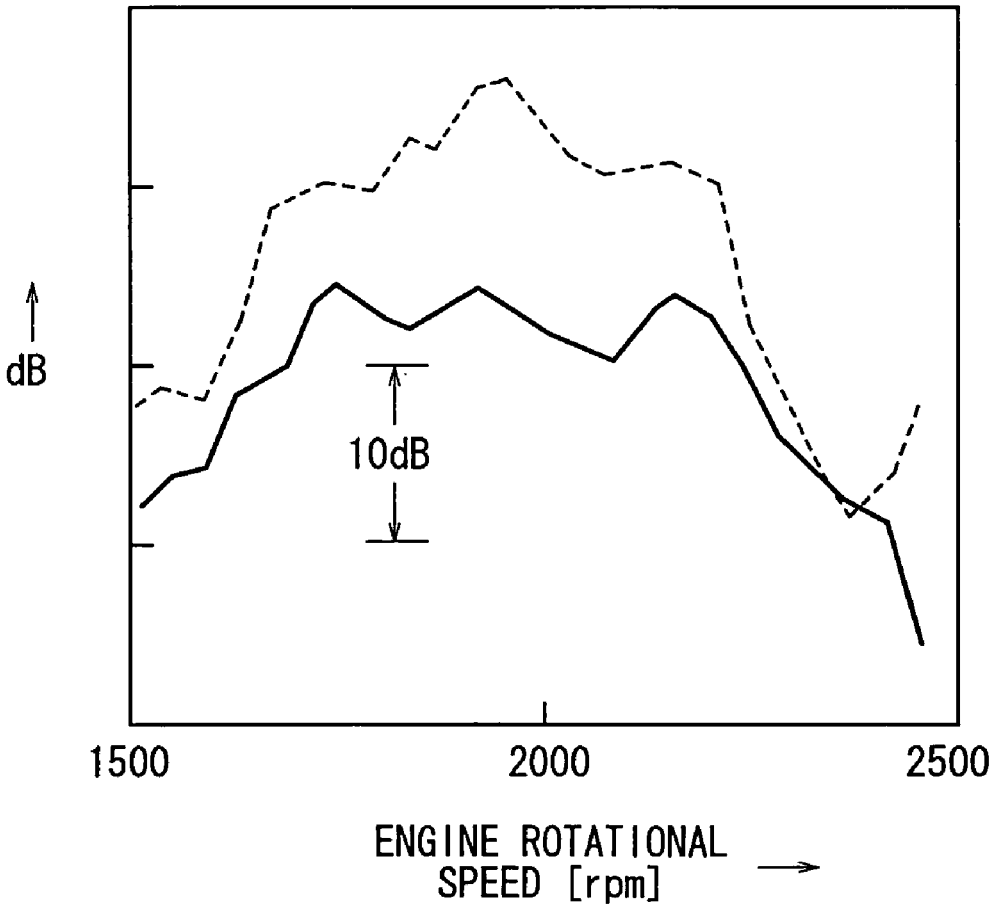
FIG. 6 is a diagram illustrative of the result of a process of reducing vibratory noise in the passenger compartment of a vehicle with the active vibratory noise control apparatus according to the present invention.

In the above example wherein the active vibratory noise control apparatus 20, 30 is incorporated in the vehicle, muffled sounds produced in the passenger compartment when the internal combustion engine is in the partial-cylinder operation mode (three cylinders are active) and the rotational speed of the output shaft of the internal combustion engine ranges from 1500 rpm to 2500 rpm are illustrated in FIG. 6. The solid-line curve represents muffled sounds produced when the active vibratory noise control process is performed, and the broken-line curve represents muffled sounds produced when the active vibratory noise control process is not performed. It can be seen from FIG. 6 that the vibratory noise in the passenger compartment is attenuated by the active vibratory noise control process that is performed by the active vibratory noise control apparatus 20, 30.

In the above embodiments, the apparatus for canceling noise in the passenger compartment has been described and illustrated. However, the present invention is not limited to the illustrated apparatus, bus is also applicable to an apparatus for reducing vibrations of the vehicle.

As described above, the active vibratory noise control apparatus according to the present invention is effective to control vibratory noise which is produced in the passenger compartment by different vibration sources such as the full-cylinder operation mode and the partial-cylinder operation mode.

Although certain preferred embodiments of the present invention have been shown and described in detail, it should be understood that various changes and modifications may be made therein without departing from the scope of the appended claims.

What is claimed is:

1. An active vibratory noise control apparatus for reducing vibratory noise which is produced in the passenger compartment of a vehicle based on vibratory noise generated by a variable-cylinder internal combustion engine that can selectively be operated in a full-cylinder operation mode in which all of the cylinders are operated and a partial-cylinder operation mode in which some of the cylinders are out of operation, comprising:

partial-cylinder operation mode determining means for determining whether the variable-cylinder internal combustion engine is in the partial-cylinder operation mode or not; and switching control means for de-energizing said active vibratory noise control apparatus when said partial-cylinder operation mode determining means applies a signal indicative of the full-cylinder operation mode, and for energizing said active vibratory noise control apparatus when said partial-cylinder operation mode determining means applies a signal indicative of the partial-cylinder operation mode.

2. An active vibratory noise control apparatus for reducing vibratory noise which is produced in the passenger compartment of a vehicle based on vibratory noise generated by a variable-cylinder internal combustion engine that can selectively be operated in a full-cylinder operation mode in which all of the cylinders are operated and a partial-cylinder operation mode in which some of the cylinders are out of operation, comprising:

number-of-active-cylinder determining means for determining the number of active cylinders of said variable-cylinder internal combustion engine; and basic frequency changing means for changing the frequency of a basic signal which is a frequency to be controlled, depending on the number of active cylinders determined by said number-of-active-cylinder determining means, so as to cancel the vibratory noise of a rotational order component when a specific number of cylinders is activated.

3. An active vibratory noise control apparatus for reducing vibratory noise which is produced in the passenger compartment of a vehicle based on vibratory noise generated by a variable-cylinder internal combustion engine that can selectively be operated in a full-cylinder operation mode in which all of the cylinders are operated and a partial-cylinder operation mode in which some of the cylinders are out of operation, comprising:

basic signal generating means for generating a basic signal having a frequency based on the frequency of the vibratory noise generated by said variable-cylinder internal combustion engine;

an adaptive filter for generating a canceling signal based on said basic signal in order to cancel the vibratory noise which is produced in the passenger compartment based on the vibratory noise generated by the variable-cylinder internal combustion engine;

a secondary vibration source for generating a canceling vibration or a canceling sound based on the canceling signal generated by said adaptive filter;

error detecting means for detecting the difference between the vibratory noise in the passenger compartment and the canceling vibration or the canceling sound, and outputting a signal based on said difference as an error signal;

reference signal generating means for correcting said basic signal based on a corrective value depending on signal transfer characteristics from said secondary vibration source to said error detecting means, thereby to generate a reference signal;

filter coefficient updating means for sequentially updating filter coefficients of said adaptive filter for minimizing said error signal based on said reference signal and said error signal;

number-of-active-cylinder determining means for determining the number of active cylinders of said variable-cylinder internal combustion engine; and basic frequency changing means for changing the frequency of the basic signal depending on the number of active cylinders determined by said number-of-active-cylinder determining means, so as to cancel the vibratory noise of a rotational order component when a specific number of cylinders is activated.

* * * * *

UNITED STATES PATENT AND TRADEMARK OFFICE

CERTIFICATE OF CORRECTION

PATENT NO. : 7,620,188 B2
APPLICATION NO. : 10/866986
DATED : November 17, 2009
INVENTOR(S) : Inoue et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1555 days.

Signed and Sealed this

Twenty-sixth Day of October, 2010

David J. Kappos

David J. Kappos
*Director of the United States Patent and Trademark Office*